US009779667B2

(12) United States Patent
Lim et al.

(10) Patent No.: US 9,779,667 B2
(45) Date of Patent: Oct. 3, 2017

(54) ORGANIC LIGHT EMITTING DISPLAY DEVICE AND METHOD FOR DRIVING THE SAME

(71) Applicant: SAMSUNG DISPLAY CO., LTD., Yongin, Gyeonggi-Do (KR)

(72) Inventors: Chai-Hoon Lim, Yongin (KR); Sang-Myeon Han, Yongin (KR); Baek-Woon Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 73 days.

(21) Appl. No.: 14/639,893

(22) Filed: Mar. 5, 2015

(65) Prior Publication Data

US 2015/0262532 A1 Sep. 17, 2015

(30) Foreign Application Priority Data

Mar. 17, 2014 (KR) ..... 10-2014-0030808

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01); *G09G 2310/027* (2013.01); *G09G 2320/0223* (2013.01); *G09G 2330/021* (2013.01); *G09G 2360/16* (2013.01)

(58) Field of Classification Search
CPC ..... G09G 2310/027; G09G 2330/023; G09G 2330/028; G09G 2330/021; G09G 2320/0626; G09G 3/3208
See application file for complete search history.

(56) References Cited

U.S. PATENT DOCUMENTS

| | | | | |
|---|---|---|---|---|
| 9,257,072 | B2 * | 2/2016 | Han | G09G 3/3233 |
| 2004/0201582 | A1 * | 10/2004 | Mizukoshi | G09G 3/3233 345/211 |
| 2010/0149162 | A1 | 6/2010 | Park et al. | |
| 2012/0044270 | A1 | 2/2012 | Arkhipov et al. | |
| 2014/0320546 | A1 * | 10/2014 | Lim | G09G 3/3291 345/690 |

FOREIGN PATENT DOCUMENTS

| | | | |
|---|---|---|---|
| KR | 10-2010-0068075 | A | 6/2010 |
| KR | 10-2012-0017968 | A | 2/2012 |
| KR | 10-2012-0139092 | A | 12/2012 |
| KR | 10-2013-0012762 | A | 2/2013 |
| KR | 10-2013-0017603 | A | 2/2013 |

* cited by examiner

*Primary Examiner* — Ifedayo Iluyomade

(74) *Attorney, Agent, or Firm* — Lewis Roca Rothgerber Christie LLP

(57) ABSTRACT

Provided is an organic light emitting display device including: a display panel including data lines, scan lines, and pixels coupled to the data lines and the scan lines; a digital data converter configured to calculate a panel load utilizing digital video data, and to convert the digital video data such that peak luminance of the pixels have a maximum value when the panel load is equal to or less than a limit value; a data driver configured to convert digital conversion data, which has been converted by the digital data converter, into data voltages, and to supply the data voltages to the data lines; and a scan driver configured to provide scan signals to the scan lines.

12 Claims, 6 Drawing Sheets

ORGANIC LIGHT EMITTING DISPLAY DEVICE AND METHOD FOR DRIVING THE SAME

CROSS-REFERENCE TO RELATED APPLICATION

This application claims priority to and the benefit of Korean Patent Application No. 10-2014-0030808, filed on Mar. 17, 2014, in the Korean Intellectual Property Office, the entire contents of which are incorporated herein by reference in their entirety.

BACKGROUND

1. Field

Aspects of example embodiments of the present invention relate to an organic light emitting display device and a method for driving the organic light emitting display device.

2. Description of the Related Art

In recent years, there have been developed various types of flat panel display devices having reduced weight and volume in comparison to cathode ray tubes. The flat panel display devices include liquid crystal display devices, field emission display devices, plasma display panels, and organic light emitting display devices.

Among the flat panel display devices, the organic light emitting display device displays an image using organic light emitting diodes (OLEDs) that generate light through the recombination of electrons and holes. The organic light emitting display device has a high response speed and is driven with low power consumption.

The organic light emitting display device includes a data driver configured to supply data voltages to data lines, a scan driver configured to provide scan signals to scan lines, and pixels located at areas defined by crossing regions of the scan lines and the data lines. The pixels emit light with a predetermined luminance by controlling a current that is supplied to the OLED corresponding to a data voltage supplied to a gate electrode of a driving transistor.

As the luminance of the image displayed on the organic light emitting display device becomes higher, a display panel load becomes higher. In this regard, the display panel load refers to currents flowing in the OLEDs of the pixels of the display panel, namely, a total current flowing in the display panel. However, an increase in display panel load leads to an increase in power consumption of the organic light emitting display device.

SUMMARY

Aspects of example embodiments of the present invention relate to an organic light emitting display device and a method for driving the organic light emitting display device, which are capable of reducing power consumption.

According to an embodiment of the present invention, there is provided an organic light emitting display device including: a display panel including data lines, scan lines, and pixels coupled to the data lines and the scan lines; a digital data converter configured to calculate a panel load utilizing digital video data, and to convert the digital video data such that peak luminance of the pixels have a maximum value when the panel load is equal to or less than a limit value; a data driver configured to convert digital conversion data, which has been converted by the digital data converter, into data voltages, and to supply the data voltages to the data lines; and a scan driver configured to provide scan signals to the scan lines.

The digital data converter may be configured to convert the digital conversion data such that the peak luminance of the pixel is reduced as the panel load increases, when the panel load is more than the limit value.

The digital data converter may include a panel load calculator, and the panel load calculator may be configured to calculate the panel load from a value that is obtained by dividing a sum of digital video data of one frame period by a maximum value of the sum of the digital video data of the one frame period.

The digital data converter may further include a conversion factor calculator, and the conversion factor calculator may be configured to calculate first and second conversion factors according to following Equations, and to determine a smaller one of the first and second conversion factors as a conversion factor:

$$CF1 = \frac{NPC_{LIMIT}}{PL}$$

$$CF2 = 1 - \delta \times PL$$

where the panel load is designated as PL, the limit value is designated as $NPC_{LIMIT}$, the first conversion factor is designated as CF1, the second conversion factor is designated as CF2, and a proportional constant multiplied by the panel load is designated as δ.

The digital data converter may further include a first data converter configured to calculate first digital conversion data by multiplying the digital video data of the one frame period by the conversion factor.

The digital data converter may further include an IR drop compensator configured to calculate compensation data utilizing the panel load, a maximum value of the panel load, the sum of the digital video data of the one frame period, and the maximum value of the sum of the digital video data of the one frame period.

The digital data converter may further include a second data converter configured to calculate second digital conversion data by adding the first digital conversion data and the compensation data, and to output the second digital conversion data as the digital conversion data.

According to another embodiment of the present invention, there is provided a method for driving an organic light emitting display device including a display panel having a pixel, the method including: calculating a panel load utilizing digital video data; and adjusting peak luminance of the pixel depending on the panel load, wherein the adjusting of the peak luminance of the pixel depending on the panel load includes: setting the peak luminance of the pixel as a maximum value when the panel load is equal to or less than a limit value; and reducing the peak luminance of the pixel as the panel load increases when the panel load is greater than the limit value.

The calculating of the panel load may include calculating the panel load from a value that is obtained by dividing a sum of digital video data of one frame period by a maximum value of the sum of the digital video data of the one frame period.

The adjusting of the peak luminance of the pixel depending on the panel load may include calculating first and second conversion factors according to following Equations and then determining a smaller one of the first and second conversion factors as a conversion factor:

$$CF1 = \frac{NPC_{LIMIT}}{PL}$$

$$CF2 = 1 - \delta \times PL$$

where the panel load is designated as PL, the limit value is designated as $NPC_{LIMIT}$, the first conversion factor is designated as CF1, the second conversion factor is designated as CF2, and a proportional constant multiplied by the panel load is designated as δ.

The adjusting of the peak luminance of the pixel depending on the panel load may include calculating first digital conversion data by multiplying the digital conversion data of the one frame period by the conversion factor.

The method may further include calculating compensation data utilizing the panel load, a maximum value of the panel load, the sum of the digital video data of the one frame period, and the maximum value of the sum of the digital video data of the one frame period.

The method may further include calculating second digital conversion data by adding the first digital conversion data and the compensation data.

The method may further include: converting the second digital conversion data into data voltages and supplying the data voltages to data lines; and providing scan signals to scan lines.

BRIEF DESCRIPTION OF THE DRAWINGS

Aspects of example embodiments will now be described more fully hereinafter with reference to the accompanying drawings; however, the present invention may be embodied in different forms and should not be construed as limited to the example embodiments set forth herein. Rather, these embodiments are provided so that this disclosure will be thorough and complete, and will fully convey the spirit and scope of the present invention to those skilled in the art.

In the drawing figures, dimensions may be exaggerated for clarity of illustration. It will be understood that when an element is referred to as being "between" two elements, it can be the only element between the two elements, or one or more intervening elements may also be present. Likewise, when an element is described as "coupled" or "connected" to another element, the element may be "directly coupled" or "directly connected" to the other element, or "indirectly coupled" or "indirectly connected" to the other element through one or more intervening elements. Like reference numerals refer to like elements throughout.

DETAILED DESCRIPTION

Figure 1:
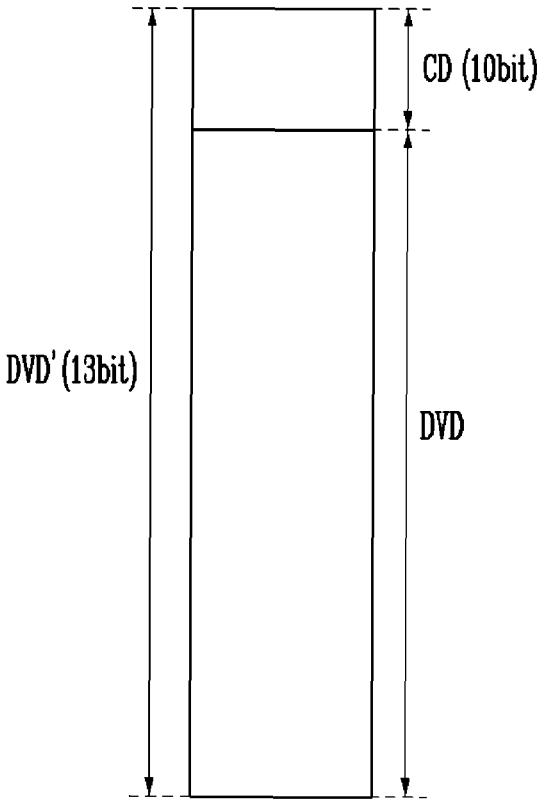
FIG. 1 is a view illustrating a range of digital video data when an IRD algorithm (e.g., an IR drop compensation algorithm) is applied.

The present invention will be described more fully hereinafter with reference to the accompanying drawings, in which example embodiments of the present invention are shown. The present invention may, however, be embodied in various different forms and should not be construed as limited to the embodiments set forth herein. Like reference numerals designate like elements throughout the specification. In the following description, detailed description of a known function or configuration that are not necessary to those skilled in the art for a complete understanding of the present invention may have been omitted.

FIG. 1 is a view illustrating digital conversion data provided from a timing controller to a data driver when an IRD algorithm is applied. The IRD algorithm is an algorithm for compensating for the IR drop of a first power voltage that is supplied to a display panel.

Referring to FIG. 1, digital conversion data DVD' provided from the timing controller to the data driver may be calculated by adding digital video data DVD and compensation data CD. The digital video data DVD refers to digital data that is input from an external system board, while the compensation data CD refers to digital data that is calculated using the IRD algorithm. The IRD algorithm is an algorithm for compensating for the IR drop of the first power voltage of the organic light emitting display device.

In FIG. 1, the compensation data CD is 10-bit digital data, and the digital conversion data DVD' is 13-bit digital data. In this case, since 10 bits represent $2^{10}$ (=1024) and 13 bits represent $2^{13}$ (=8192), the digital conversion data DVD' may have values of 0 to 8191, the digital video data DVD may have values of 0 to 7168, and the compensation data CD may have values of 0 to 1023.

Figure 2A:
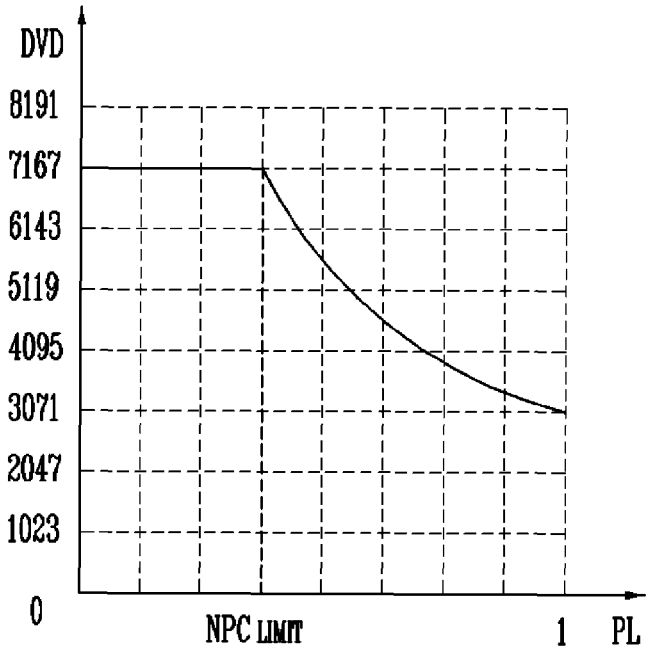
FIG. 2A is a graph illustrating a peak value of digital video data as a function of a display panel load when a conventional power-consumption reducing algorithm is applied.
Figure 2B:
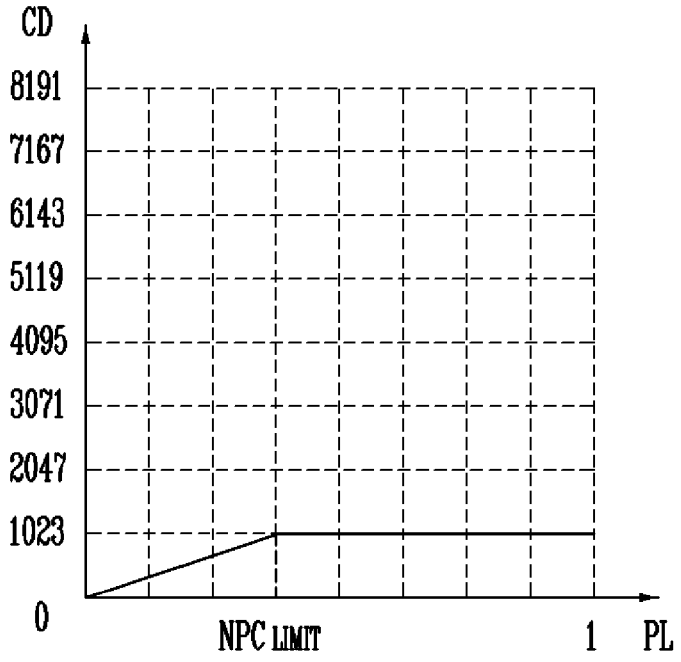
FIG. 2B is a graph illustrating compensation data as a function of a display panel load when a conventional IRD algorithm is applied.
Figure 2C:
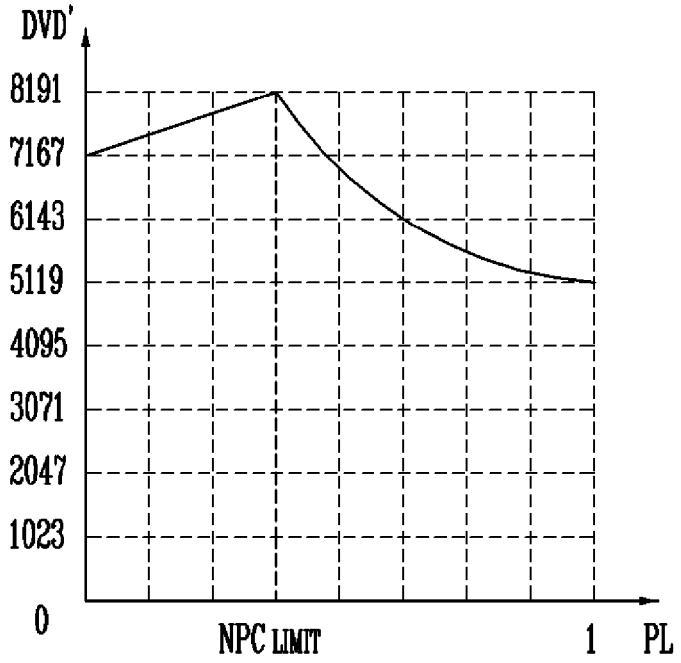
FIG. 2C is a graph illustrating a peak value of digital conversion data as a function of a display panel load when both the conventional power-consumption reducing algorithm and the conventional IRD algorithm are applied.

FIG. 2A is a graph illustrating a peak value of digital video data as a function of a display panel load when a conventional power-consumption reducing algorithm is applied. FIG. 2B is a graph illustrating compensation data as a function of a display panel load when a conventional IRD algorithm is applied. FIG. 2C is a graph illustrating a peak value of digital conversion data as a function of a display panel load when both the conventional power-consumption reducing algorithm and the conventional IRD algorithm are applied.

In FIGS. 2A to 2C, the x-axis denotes the display panel load PL (hereinafter referred to as the "panel load"). The panel load PL refers to total current flowing in the display panel 10. The y-axis of FIG. 2A denotes the peak value of the digital video data DVD, the y-axis of FIG. 2B denotes the compensation data CD, and the y-axis of FIG. 2C denotes the peak value of the digital conversion data DVD'. Since the pixels of the organic light emitting display device receive analog data voltage converted from the digital conversion data DVD' and then emit light in response to the data voltage, the peak value of the digital conversion data DVD' denotes the peak luminance of the pixels.

Referring to FIG. 2A, the conventional power-consumption reducing algorithm controls the peak value of the digital video data DVD depending on the panel load PL. To be more specific, if the panel load PL is equal to or less than a limit value $NPC_{LIMIT}$, the conventional power-consumption reducing algorithm performs control such that the peak value of the digital video data DVD has a maximum value that may be represented by the digital video data DVD, regardless of the panel load PL. As illustrated in FIG. 1, if the digital conversion data DVD' is 13 bits and the compensation data CD is 10 bits, the maximum value of the digital video data DVD may be 7168. Further, if the panel load PL is greater than the limit value $NPC_{LIMIT}$, the conventional power-consumption reducing algorithm performs control such that the peak value of the digital video data DVD is reduced as the panel load PL is increased. The limit value $NPC_{LIMIT}$ may have a value of 0 to 1, the value being preset to a proper value through experiments.

Referring to FIG. 2B, the conventional IRD algorithm controls the compensation data CD depending on the panel load PL. Specifically, the conventional IRD algorithm performs control such that the compensation data CD is increased as the panel load PL is increased, if the panel load PL is equal to or less than the limit value $NPC_{LIMIT}$. Further, the conventional IRD algorithm performs control such that the compensation data CD has the maximum value regardless of the panel load PL if the panel load PL is more than the limit value $NPC_{LIMIT}$. As illustrated in FIG. 1, when the compensation data CD is 10 bits, the maximum value of the compensation data CD may be 1023.

Referring to FIG. 2C, the conventional power-consumption control algorithm employing both the conventional power-consumption reducing algorithm and the conventional IRD algorithm may calculate the peak value of the digital conversion data DVD', by adding the peak value of the digital video data DVD calculated from the conventional power-consumption algorithm and the compensation data CD calculated from the conventional IRD algorithm. Thus, if the panel load PL is equal to or less than the limit value $NPC_{LIMIT}$, the conventional power-consumption control algorithm performs control such that the peak value of the digital conversion data DVD' is increased as the panel load PL is increased. On the other hand, if the panel load PL is more than the limit value $NPC_{LIMIT}$, the conventional power-consumption control algorithm performs control such that the peak value of the digital conversion data DVD' is reduced as the panel load PL is increased. Thus, if the panel load PL is the limit value $NPC_{LIMIT}$ as shown in FIG. 2C, the peak value of the digital conversion data DVD' has the maximum value that may be represented by the digital conversion data DVD'. If the digital conversion data DVD' is 13 bits as illustrated in FIG. 1, the maximum value of the digital conversion data DVD' may be 8191.

Therefore, as shown in FIG. 2C, although the conventional power-consumption control algorithm may perform control such that the peak value of the digital conversion data DVD' has the maximum value, if the panel load PL is less than the limit value $NPC_{LIMIT}$, this is not realized. Hence, although a contrast ratio may be increased by controlling the peak luminance of the pixel such that it becomes higher, if the panel load is equal to or less than the limit value, this is not realized.

Hereinafter, an organic light emitting display device and a method for driving the organic light emitting display device according to embodiments of the present invention will be described in detail with reference to FIGS. 3 to 7C.

Figure 3:
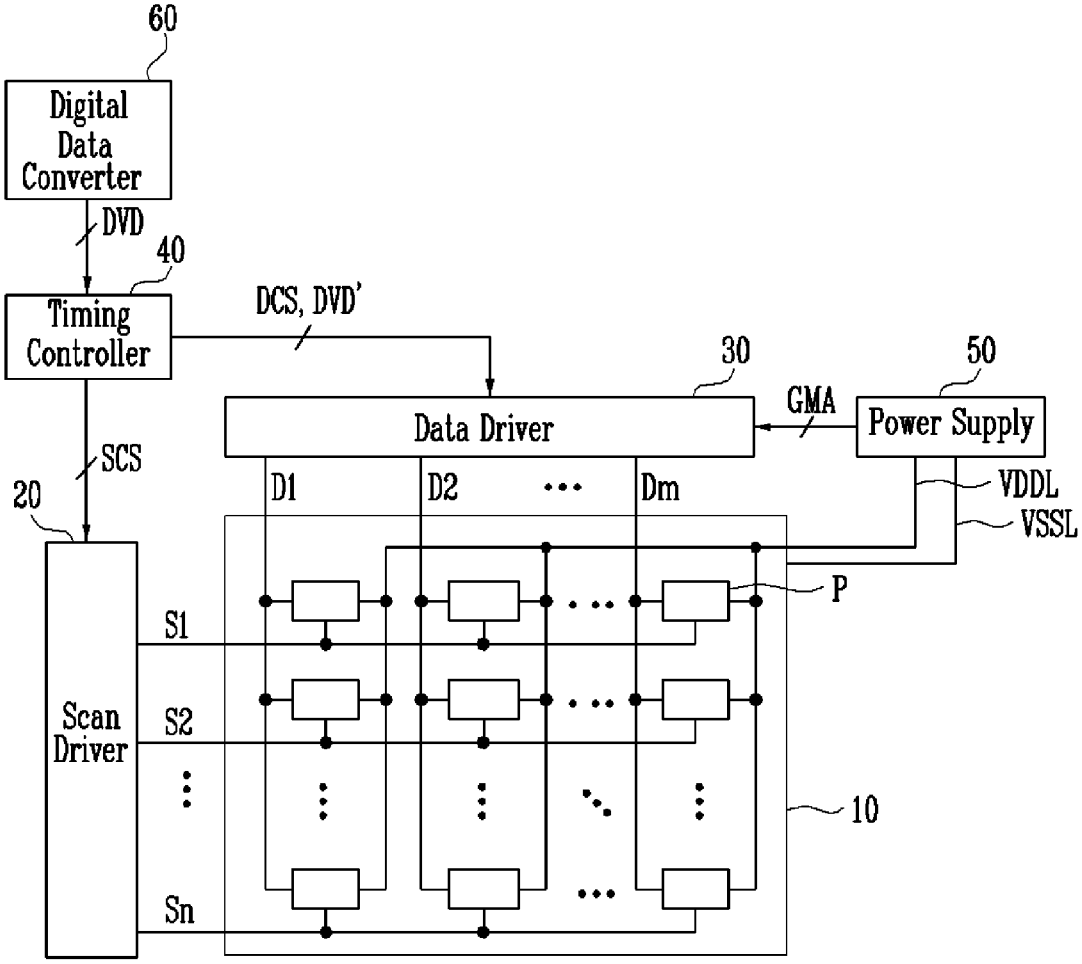
FIG. 3 is a block diagram illustrating an organic light emitting display device according to an embodiment of the present invention.

FIG. 3 is a block diagram illustrating an organic light emitting display device according to an embodiment of the present invention. Referring to FIG. 3, the organic light emitting display device includes a display panel 10, a scan driver 20, a data driver 30, a timing controller 40, a power supply 50, and a digital data converter 60.

Data lines D1 to Dm (m is a positive integer of 2 or more) and scan lines S1 to Sn (n is a positive integer of 2 or more) are formed on the display panel 10 in such a way as to cross each other. Pixels P are formed on the display panel 10 in a matrix form, and are respectively coupled to the data lines D1 to Dm and the scan lines S1 to Sn.

Figure 4:
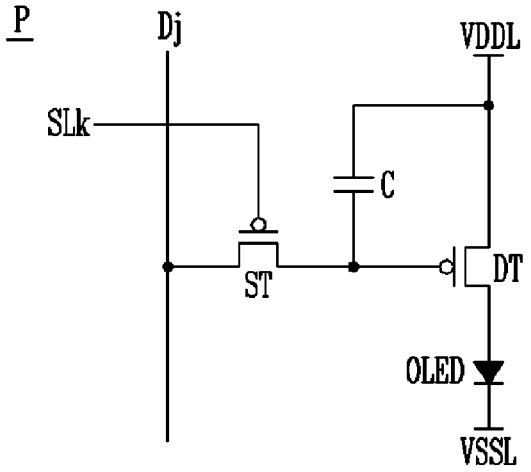
FIG. 4 is an equivalent circuit diagram of pixels shown in FIG. 3.

As shown in FIG. 4, for example, a pixel from among the pixels P may be coupled to a k-th (k is a positive integer satisfying the following equation, $1 \le k \le n$) scan line, a j-th (j is a positive integer satisfying the following equation, $1 \le j \le m$) data line, a first power voltage line VDDL, and a second power voltage line VSSL. Referring to FIG. 4, each of the pixels P may include a driving transistor DT, an organic light emitting diode OLED, a scan transistor ST, and a capacitor C.

The driving transistor DT is formed between the OLED and the first power voltage line VDDL, and controls a current flowing into the OLED. For example, since a drain-source current flowing in a channel of the driving transistor DT varies depending on a data voltage supplied to the control electrode (e.g., gate electrode) of the driving transistor DT, the current flowing into the OLED may be controlled by controlling the data voltage supplied to a gate electrode of the driving transistor DT.

The control electrode of the driving transistor DT may be coupled to a second electrode of the scan transistor ST, a first electrode of the driving transistor DT may be coupled to the first power voltage line VDDL, and a second electrode of the driving transistor DT may be coupled to an anode electrode of the OLED. The control electrode may be the gate electrode of the driving transistor DT, the first electrode of the driving transistor DT may be a source electrode or a drain electrode, and the second electrode of the driving transistor DT may be an electrode different from the first electrode. For example, if the first electrode of the driving transistor DT is the source electrode, the second electrode of the driving transistor DT may be the drain electrode.

The OLED emits light corresponding to the drain-source current of the driving transistor DT. The anode electrode of the OLED may be coupled to the second electrode of the driving transistor DT, and a cathode electrode of the OLED may be coupled to the second power voltage line VSSL (e.g., a low-potential voltage line).

The scan transistor ST is coupled between the gate electrode of the driving transistor DT and the j-th data line Dj. The scan transistor ST is turned on in response to the scan signal of the k-th scan line SLk, and supplies the data voltage of the j-th data line Dj to the gate electrode of the driving transistor DT. A gate electrode of the scan transistor ST may be coupled to the k-th scan line SLk, a first electrode of the scan transistor ST may be coupled to the j-th data line Dj, and a second electrode of the scan transistor ST may be coupled to the gate electrode of the driving transistor DT.

The capacitor C is formed between the gate electrode of the driving transistor DT and the first power voltage line VDDL. The capacitor C maintains the data voltage supplied to the gate electrode of the driving transistor DT for a period of time (e.g., a predetermined period of time).

A semiconductor layer of each of the driving transistor DT and the scan transistor ST may be formed of polysilicon, but the present invention is not limited thereto, for example, the semiconductor layer may be formed of either a-Si or oxide semiconductor. In the embodiment of FIG. 3, the driving transistor DT and the scan transistor ST are formed in a P-type semiconductor, but the present invention is not limited thereto.

Further, each of the pixels P may further include a compensation circuit for compensating for a threshold voltage of the driving transistor DT. In this case, the compensation circuit may include at least one transistor. Since the compensation circuit senses the threshold voltage of the driving transistor DT and then applies the sensed threshold voltage to the gate electrode of the driving transistor DT, the drain-source current Ids of the driving transistor DT may not depend on the threshold voltage Vth of the driving transistor DT.

The scan driver 20 supplies scan signals to the scan lines S1 to Sn in response to a scan-timing control signal SCS. The scan driver 20 may sequentially supply the scan signals to the scan lines S1 to Sn.

The data driver 30 includes at least one source drive IC. The source drive IC receives a source timing control signal DCS and digital conversion data DVD' from the timing controller 40. The source drive IC receives gamma reference voltages GMA from the power supply 50. The source drive IC divides the gamma reference voltages GMA to generate gamma correction voltages. The source drive IC may convert the digital conversion data DVD' into data voltages, by selecting any one of the gamma correction voltages depending on the digital conversion data DVD'. The source drive IC is synchronized with each of the scan signals based on the source timing control signal DCS, thus supplying the data voltages to the data lines D1 to Dm. Thereby, the data voltage is supplied to each of the pixels P to which the scan signals are provided.

The timing controller 40 receives the digital conversion data DVD' from the digital data converter 60. The timing controller 40 may receive timing signals, including a vertical sync signal, a horizontal sync signal, a DVD enable signal, and a dot clock, together with the digital conversion data DVD'. The timing controller 40 is configured to generate timing control signals for controlling the operation timing of the data driver 20 and the scan driver 30, based on timing signals. The timing control signals include the scan-timing control signal SCS for controlling the operation timing of the scan driver 30, and a data-timing control signal DCS for controlling the operation timing of the data driver 20. The timing controller 40 outputs the scan-timing control signal SCS to the scan driver 30, and outputs the data-timing control signal DCS and the digital conversion data DVD' to the data driver 20.

The power supply 50 supplies a first power voltage through the first power voltage line VDDL to each of the pixels P of the display panel 10, and supplies a second power voltage through the second power voltage line VSSL to each pixel. The first power voltage may be set as a high-potential voltage ELVDD, while the second power voltage may be set as a low-potential voltage ELVSS. Further, the power supply 50 may supply a gate on voltage Von and a gate off voltage Voff to the scan driver 20. The power supply 50 may generate the gamma reference voltages GMA and supply them to the data driver 30.

The digital data converter 60 receives the digital video data DVD from the external system board. The digital data converter 60 converts the digital video data DVD, using the power-consumption control algorithm according to an embodiment of the present invention so as to reduce the power consumption of the OLED display device. The power-consumption control algorithm according to an embodiment of the present invention may include the power-consumption reducing algorithm and the IRD (IR drop) algorithm. The power-consumption reducing algorithm is an algorithm for reducing the power consumption by adjusting the peak luminance of the pixel depending on the panel load PL, while the IRD algorithm is an algorithm for compensating for the luminance loss of the pixel resulting from the IR drop of the first power voltage ELVDD. The digital data converter 60 converts the digital video data DVD into the digital conversion data DVD' using the power-consumption control algorithm, and outputs the digital conversion data DVD' to the timing controller 40. The digital data converter 60 may be included in the timing controller 40, but the present invention is not limited thereto. Hereinafter, the digital-data conversion method of the digital data converter 60 will be described in detail with reference to FIGS. 5 and 6.

Figure 5:
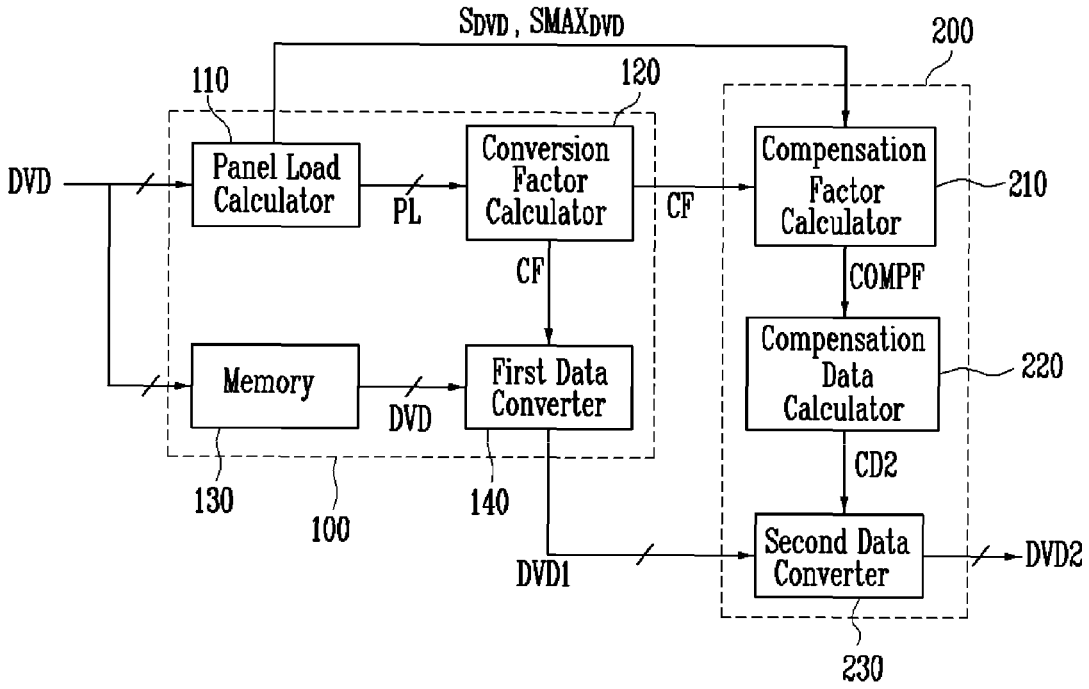
FIG. 5 is a detailed block diagram illustrating a digital data converter of FIG. 3.
Figure 6:
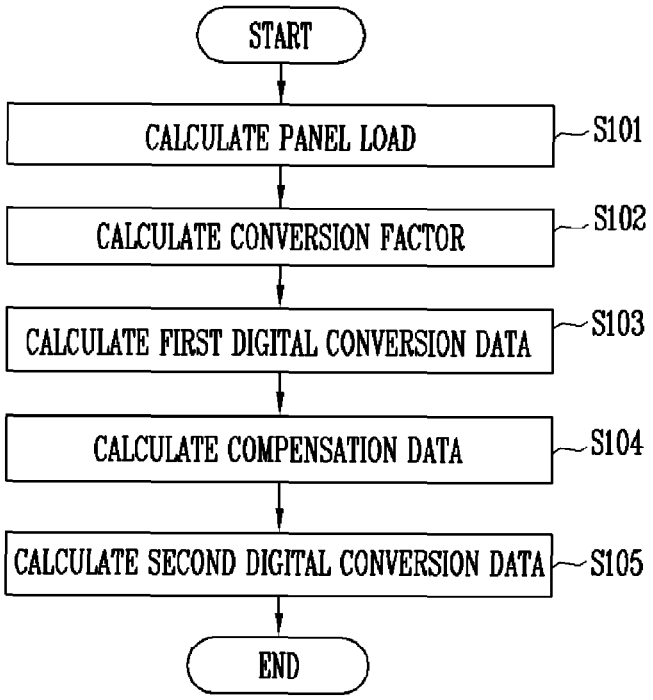
FIG. 6 is a detailed flowchart illustrating a digital-data conversion method of the digital data converter of FIG. 5.

FIG. 5 is a detailed block diagram illustrating the digital data converter of FIG. 3. FIG. 6 is a detailed flowchart illustrating the digital-data conversion method of the digital data converter of FIG. 5. Referring to FIG. 5, the digital data converter 60 includes a power-consumption reducer 100 and an IRD compensator 200.

The power-consumption reducer 100 converts the digital video data DVD so as to reduce the power consumption of the OLED display device. The power-consumption reducer 100 includes a panel load calculator 110, a conversion factor calculator 120, a memory 130, and a first data converter 140. The IRD compensator 200 converts the digital video data DVD so as to compensate for the luminance loss of the pixel resulting from the IR drop of the first power voltage ELVDD. The IRD compensator 200 includes a compensation factor calculator 210, a compensation data calculator 220, and a second data converter 230. Hereinafter, the digital-data conversion method of the digital data converter 60 will be described in detail with reference to FIGS. 5 and 6.

The panel load calculator 110 receives the digital video data DVD from the external system board. The panel load calculator 110 calculates the panel load PL using the digital video data DVD. For example, the panel load calculator 110 may calculate a value of the panel load PL, which is obtained by dividing the sum $S_{DVD}$ of the digital video data DVD of one frame period by the maximum value $SMAX_{DvD}$ of the sum of the digital video data DVD of the one frame period as in Equation 1. In this case, the panel load PL may have the value of 0 to 1. The panel load calculator 110 outputs the panel load PL to the conversion factor calculator 120. Further, the panel load calculator 110 outputs the sum $S_{DVD}$ of the digital video data DVD of the one frame period and the maximum value $SMAX_{DVD}$ of the sum of the digital video data DVD of the one frame period, to the compensation factor calculator 210.

$$PL = \frac{S_{DVD}}{SMAX_{DVD}} \quad \text{Equation 1}$$

The conversion factor calculator 120 calculates the conversion factor CF depending on the panel load PL. For example, the conversion factor calculator 120 may calculate a first conversion factor CF1 according to Equation 2, and may calculate a second conversion factor CF2 according to Equation 3.

$$CF1 = \frac{NPC_{LIMIT}}{PL} \quad \text{Equation 2}$$

$$CF2 = 1 - \delta \times PL \quad \text{Equation 3}$$

Figure 7A:
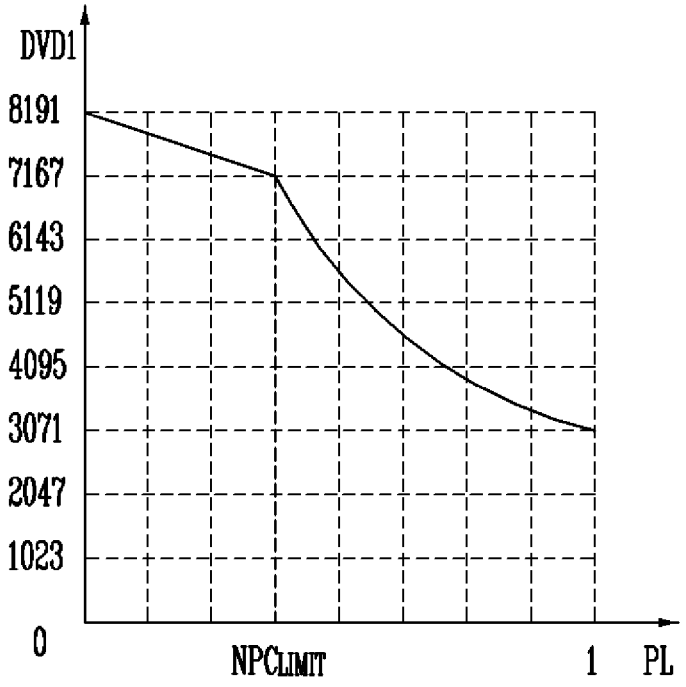
FIG. 7A is a graph illustrating a peak value of first digital conversion data as a function of a display panel load according to an embodiment of the present invention.

In Equations 2 and 3, $NPC_{LIMIT}$ may be the limit value, δ may be a proportional constant, and each of $NPC_{LIMIT}$ and δ may have a value of 0 to 1, and may be preset to a proper value through experiments. The conversion factor calculator 120 calculates a smaller one of the first conversion factor CF1 and the second conversion factor CF2 as the conversion factor CF, and then outputs the calculated value to the first data converter 140 and the compensation factor calculator 210. The conversion factor CF may have a value of 0 to 1. When the panel load PL is equal to or less than the limit value $NPC_{LIMIT}$ as shown in FIG. 7A, the first conversion factor CF1 may be calculated as the conversion factor CF. Also, when the panel load PL is greater than the limit value $NPC_{LIMIT}$ as shown in FIG. 7A, the second conversion factor may be calculated as the conversion factor CF. That is, the first conversion factor CF1 refers to a graph in linearly inverse proportion when the panel load PL is equal to or less than the limit value $NPC_{LIMIT}$ as shown in FIG. 7A, and the second conversion factor CF2 refers to a graph when the panel load PL is greater than the limit value $NPC_{LIMIT}$. Furthermore, δ may be a slope of the graph in linearly inverse proportion when the panel load PL is equal to or less than the limit value $NPC_{LIMIT}$. The conversion factor calculator 120 may change the conversion factor CF into a gray scaling factor and output the gray scaling factor to the first data converter 140 (step S102 of FIG. 6)

The memory 130 receives the digital video data DVD from the external system board. The memory 130 may be implemented as a frame memory that stores the digital video data DVD of the one frame period.

The first data converter 140 receives the digital video data DVD of the one frame period from the memory 130. Further, the first data converter 140 receives the conversion factor CF from the conversion factor calculator 120. The first data converter 140 calculates the first digital conversion data DVD1 by multiplying the digital video data DVD of the one frame period by the conversion factor CF.

In FIG. 7A, the x-axis denotes the panel load PL, and the y-axis denotes the peak value of the first digital conversion data DVD1. FIG. 7A illustrates a case where the first digital conversion data DVD1 is 13-bit digital data. Hence, the first digital conversion data DVD1 may have the value of 0 to 8191.

The first data converter 140 outputs the first digital conversion data DVD1 to the second data converter 230. The first data converter 140 may perform gamma correction for the first digital conversion data DVD1 to output a corrected value to the second data converter 230 (step S103 of FIG. 6).

The compensation factor calculator 210 receives the sum $S_{DVD}$ of the digital video data DVD of one frame period and the maximum value $SMAX_{DVD}$ of the sum of the digital video data DVD of the one frame period, from the panel load calculator 110, and receives the conversion factor CF from the conversion factor calculator 120. The compensation factor calculator 210 calculates a compensation factor COMPF, based on the sum $S_{DVD}$ of the digital video data DVD of the one frame period, the maximum value $SMAX_{DVD}$ of the sum of the digital video data DVD of the one frame period, and the conversion factor CF. The compensation factor calculator 210 may calculate the compensation factor COMPF according to Equation 4. In Equation 4, CFMAX means the maximum value of the conversion factor CF.

$$COMPF = \frac{CF \times S_{DVD}}{CFMAX \times SMAX_{DVD}} \quad \text{Equation 4}$$

The compensation data calculator 220 may include a compensation look-up table. The compensation look-up table stores first compensation data CD1 for compensating for the IR drop of the first power voltage ELVDD. The first compensation data CD1 stored in the compensation look-up table may be calculated through given measurement after the OLED display device has been manufactured. The compensation data calculator 220 calculates second compensation data CD2, based on the first compensation data CD1 and the compensation factor COMPF. The compensation data calculator 220 may calculate the second compensation data CD2 by multiplying the first compensation data CD1 by the compensation factor COMPF according to Equation 5.

$$CD2 = COMPF \times CD1 \quad \text{Equation 5}$$

Figure 7B:
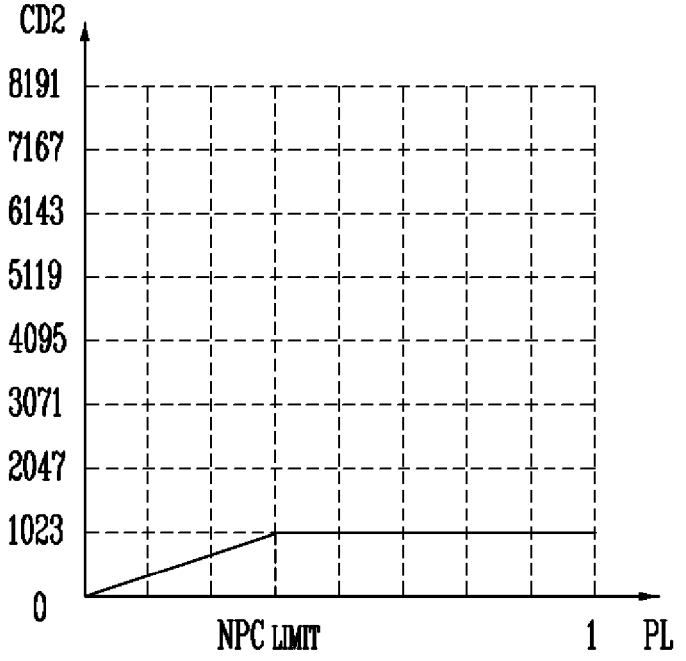
FIG. 7B is a graph illustrating compensation data as a function of the display panel load according to the embodiment of the present invention.

FIG. 7B illustrates an example where the second compensation data CD2 is calculated to be in linearly proportion to the panel load PL when the panel load PL is equal to or less than the limit value $NPC_{LIMIT}$, and the second compensation data CD2 is calculated to have a maximum value that may be represented by the second compensation data CD2 when the panel load PL is greater than the limit value $NPC_{LIMIT}$, but the present invention is not limited thereto. In FIG. 7B, the x-axis denotes the panel load PL, and the y-axis denotes the second compensation data CD2. FIG. 7B illustrates a case where the second compensation data CD2 is 10-bit digital data. Hence, the second compensation data CD2 may have the value of 0 to 1023 (step S104 of FIG. 6).

The second data converter 230 receives the first digital conversion data DVD1 from the first data converter 140, and receives the second compensation data CD2 from the compensation data calculator 220. The second data converter 230 adds the first digital conversion data DVD1 and the second compensation data CD2 to calculate the second digital conversion data DVD2 according to Equation 6.

$$DVD2 = DVD1 + CD2 \quad \text{Equation 6}$$

Figure 7C:
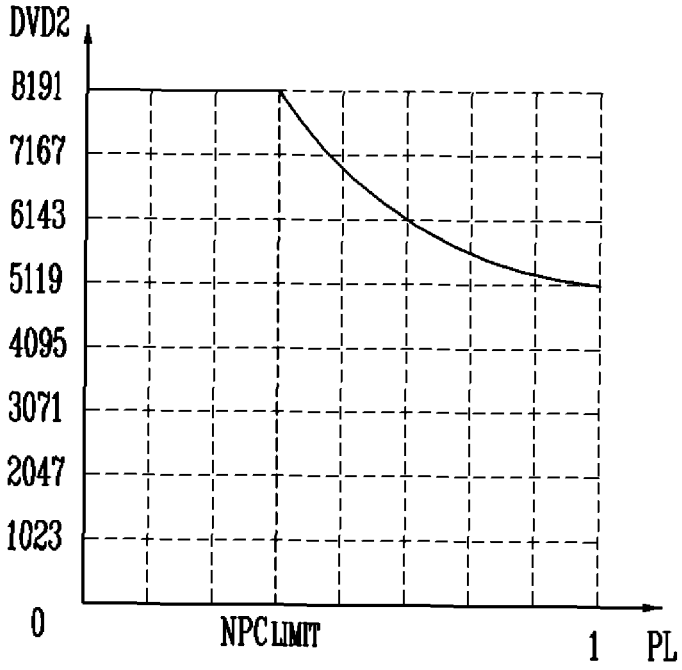
FIG. 7C is a graph illustrating a peak value of second digital conversion data as a function of the display panel load according to the embodiment of the present invention.

Thus, when the panel load PL is equal to or less than the limit value $NPC_{LIMIT}$ as shown in FIG. 7C, the peak value of the second digital conversion data DVD2 may be calculated to be the maximum value that may be represented by the second digital conversion data DVD2. Further, when the panel load PL is greater than the limit value $NPC_{LIMIT}$ as shown in FIG. 7C, the peak value of the second digital conversion data DVD2 may be calculated to be in exponentially inverse proportion to the panel load PL. In FIG. 7C, the x-axis denotes the panel load PL, and the y-axis denotes the peak value of the second digital conversion data DVD2. FIG. 7C illustrates a case where the second digital conversion data DVD2 is 13-bit digital data. Hence, the second digital conversion data DVD2 may have the value of 0 to 8191.

The second data converter 230 outputs the second digital conversion data DVD2 as the digital conversion data DVD' to the timing controller 40. Consequently, since the digital conversion data DVD' is converted into the analog data voltage and then supplied to the pixel, it can be seen that the peak value of the digital conversion data DVD' represents the peak luminance of the pixel (step S105 of FIG. 6).

By way of summation and review, according to embodiments of the present invention, the digital video data is converted into the digital conversion data DVD' to adjust the peak luminance of the pixel depending on the panel load PL. For example, according to an embodiment of the present invention, if the panel load is more than the limit value $NPC_{LIMIT}$, the peak luminance of the pixel (or the peak value of the digital conversion data DVD') is reduced as the panel load increases, thus realizing a reduction in power consumption. Further, according to an embodiment of the present invention, if the panel load PL is equal to or less than the limit value $NPC_{LIMIT}$, the peak luminance of the pixel (or the peak value of the digital conversion data DVD') is set as the maximum value, thus enabling the peak luminance of the pixel to be controlled to be higher at a low grayscale level as compared to the comparative example, and thereby allowing a contrast ratio to be increased at the low grayscale level.

Example embodiments have been described herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments, unless otherwise specifically indicated. Accordingly, it will be understood by those of skill in the art that various changes in form and detail may be made without departing from the spirit and scope of the present invention as set forth in the following claims, and their equivalents.

What is claimed is:

1. An organic light emitting display device comprising:

a display panel comprising data lines, scan lines, and pixels coupled to the data lines and the scan lines;

a digital data converter configured to calculate a panel load utilizing digital video data, and to convert the digital video data such that peak luminance of the pixels maintains a maximum value when the panel load is equal to or less than a limit value;

a data driver configured to convert digital conversion data, which has been converted by the digital data converter, into data voltages, and to supply the data voltages to the data lines; and a scan driver configured to provide scan signals to the scan lines, wherein the digital data converter comprises a panel load calculator, and the panel load calculator is configured to calculate the panel load from a value that is obtained by dividing a sum of digital video data of one frame period by a maximum value of the sum of the digital video data of the one frame period.

2. The organic light emitting display device as claimed in claim 1, wherein the digital data converter is configured to convert the digital conversion data such that the peak luminance of the pixel is reduced as the panel load increases, when the panel load is more than the limit value.

3. The organic light emitting display device as claimed in claim 1, wherein the digital data converter further comprises a conversion factor calculator, and the conversion factor calculator is configured to calculate first and second conversion factors according to following Equations, and to determine a smaller one of the first and second conversion factors as a conversion factor:

$$CF1 = \frac{NPC_{LIMIT}}{PL}$$

$$CF2 = 1 - \delta \times PL$$

where the panel load is designated as PL, the limit value is designated as $NPC_{LIMIT}$, the first conversion factor is designated as CF1, the second conversion factor is designated as CF2, and a proportional constant multiplied by the panel load is designated as δ.

4. The organic light emitting display device as claimed in claim 3, wherein the digital data converter further comprises: a first data converter configured to calculate first digital conversion data by multiplying the digital video data of the one frame period by the conversion factor.

5. The organic light emitting display device as claimed in claim 4, wherein the digital data converter further comprises: an IR drop compensator configured to calculate compensation data utilizing the panel load, a maximum value of the panel load, the sum of the digital video data of the one frame period, and the maximum value of the sum of the digital video data of the one frame period.

6. The organic light emitting display device as claimed in claim 5, wherein the digital data converter further comprises: a second data converter configured to calculate second digital conversion data by adding the first digital conversion data and the compensation data, and to output the second digital conversion data as the digital conversion data.

7. A method for driving an organic light emitting display device comprising a display panel comprising a pixel, the method comprising:

calculating a panel load utilizing digital video data; and adjusting peak luminance of the pixel depending on the panel load, wherein the adjusting of the peak luminance of the pixel depending on the panel load comprises:

setting the peak luminance of the pixel to maintain a maximum value when the panel load is equal to or less than a limit value; and reducing the peak luminance of the pixel as the panel load increases when the panel load is greater than the limit value, wherein the calculating of the panel load comprises: calculating the panel load from a value that is obtained by dividing a sum of digital video data of one frame period by a maximum value of the sum of the digital video data of the one frame period.

8. A method for driving an organic light emitting display device comprising a display panel comprising a pixel, the method comprising:

calculating a panel load utilizing digital video data; and adjusting peak luminance of the pixel depending on the panel load, wherein the adjusting of the peak luminance of the pixel depending on the panel load comprises:

setting the peak luminance of the pixel as a maximum value when the panel bad is equal to or less than a limit value; and reducing the peak luminance of the pixel as the panel load increases when the panel load is greater than the limit value, wherein the calculating of the panel load comprises calculating the panel load from a value that is obtained by dividing a sum of digital video data of one frame period by a maximum value of the sum of the digital video data of the one frame period, and wherein the adjusting of the peak luminance of the pixel depending on the panel load comprises calculating first and second conversion factors according to following Equations and then determining a smaller one of the first and second conversion factors as a conversion factor:

$$CF1 = \frac{NPC_{LIMIT}}{PL}$$

$$CF2 = 1 - \delta \times PL$$

where the panel load is designated as PL, the limit value is designated as $NPC_{LIMIT}$, the first conversion factor is designated as CF1, the second conversion factor is designated as CF2, and a proportional constant multiplied by the panel load is designated as δ.

9. The method as claimed in claim 8, wherein the adjusting of the peak luminance of the pixel depending on the panel load comprises calculating first digital conversion data by multiplying the digital video data of the one frame period by the conversion factor.

10. The method as claimed in claim 9, further comprising:

calculating compensation data utilizing the panel load, a maximum value of the panel load, the sum of the digital video data of the one frame period, and the maximum value of the sum of the digital video data of the one frame period.

11. The method as claimed in claim 10, further comprising:

calculating second digital conversion data by adding the first digital conversion data and the compensation data.

12. The method as claimed in claim 11, further comprising:

converting the second digital conversion data into data voltages and supplying the data voltages to data lines; and providing scan signals to scan lines.

* * * * *